US008182373B2

(12) United States Patent
Delorme

(10) Patent No.: US 8,182,373 B2
(45) Date of Patent: May 22, 2012

(54) HOCKEY TRAINING DEVICE

(75) Inventor: Pierre Delorme, Ottawa (CA)

(73) Assignee: Hockey Stars Training and Development Inc., Sherbrooke (CA)

( * ) Notice: Subject to any disclaimer, the term of this patent is extended or adjusted under 35 U.S.C. 154(b) by 181 days.

(21) Appl. No.: 12/764,463

(22) Filed: Apr. 21, 2010

(65) Prior Publication Data

US 2011/0263355 A1 Oct. 27, 2011

(51) Int. Cl.
*A63B 69/00* (2006.01)

(52) U.S. Cl. ..... 473/446; 473/422; 463/2

(58) Field of Classification Search ..... 473/446, 473/422; 273/108.57; 340/815.4; 463/2
See application file for complete search history.

(56) References Cited

U.S. PATENT DOCUMENTS

| | | | | |
|---|---|---|---|---|
| 3,912,269 | A * | 10/1975 | Barlow | 273/108.51 |
| 4,018,443 | A * | 4/1977 | Bird | 473/471 |
| 4,607,842 | A | 8/1986 | Daoust | |
| 5,249,797 | A * | 10/1993 | Dowhy | 473/446 |
| 5,356,135 | A | 10/1994 | Montgomery | |
| 5,615,880 | A | 4/1997 | Booth et al. | |
| 5,931,465 | A * | 8/1999 | Miyake et al. | 273/108.1 |
| 6,514,140 | B1 * | 2/2003 | Storch | 463/25 |
| 6,575,851 | B1 * | 6/2003 | Lamberti et al. | 473/435 |
| 6,682,070 | B1 * | 1/2004 | Rosenfeld et al. | 273/108.1 |
| 7,115,053 | B2 | 10/2006 | Meichner | |
| 7,134,976 | B1 | 11/2006 | Smith | |
| 7,166,045 | B1 * | 1/2007 | Linner et al. | 473/446 |
| 2004/0142775 | A1 * | 7/2004 | Nudo | 473/446 |
| 2007/0184920 | A1 | 8/2007 | Mah et al. | |
| 2007/0191140 | A1 * | 8/2007 | Andrea et al. | 473/446 |
| 2007/0191141 | A1 * | 8/2007 | Weber | 473/446 |
| 2008/0182687 | A1 | 7/2008 | Ahern | |
| 2009/0149280 | A1 * | 6/2009 | Wagner | 473/446 |
| 2010/0113197 | A1 * | 5/2010 | Martin et al. | 473/588 |
| 2010/0201537 | A1 * | 8/2010 | Martin et al. | 340/686.6 |
| 2011/0263355 | A1 * | 10/2011 | Delorme | 473/446 |

FOREIGN PATENT DOCUMENTS

CA 2391031 1/2004

OTHER PUBLICATIONS

Webpagedownload, mikohn, 2004, web.archive.org/web/20040611025412/www.mikohn.com, 8 pages.*

* cited by examiner

*Primary Examiner* — Gene Kim
*Assistant Examiner* — M Chambers
(74) *Attorney, Agent, or Firm* — Coudreau Gage Dubuc; Isabelle Pelletier

(57) ABSTRACT

A hockey training device includes a substantially elevated panel and a substantially horizontally positioned board having a top playing surface on which a puck is to be moved, following instantly on-and-off conditions of lights distributed in desired locations on the playing surface. The elevated panel displays the locations of the lights with the instant on-and-off condition of the lights to guide the player in a head-up position, to move the puck to the location of the light which is currently turned on, on the playing surface.

20 Claims, 4 Drawing Sheets

HOCKEY TRAINING DEVICE

TECHNICAL FIELD

This invention relates to the field of hockey and more particularly to a practice apparatus such as a hockey training device for enhancing a hockey player's skills in the art of stick handling.

BACKGROUND OF THE INVENTION

In the past, it has been recognized that there exists a need for an apparatus or device to facilitate the very real needs of a hockey player to enhance the player's skills in the art of stick handling and to improve his/her reflexes when manipulating a hockey puck for controlling the puck with speed and accuracy. However, most hockey training apparatus disclosed in the prior art are not designed for improving reflex action but more particularly address goal shooting and are usually complicated.

Therefore, there exists a need for a compact, simple hockey training device for enhancing hockey player's skills in the art of stick handling to improve their hockey puck control with speed and accuracy.

SUMMARY OF THE INVENTION

In accordance with one aspect of the present invention, there is provided a hockey training device which comprises a puck; a substantially horizontally positioned board having a top playing surface, the puck being moved on the playing surface by a player during selected games; a number of lights installed under the playing surface of the board and distributed at desired locations on the playing surface; a plurality of sensors installed under the playing surface of the board, at least one of the sensors being positioned at the location of each light to sense the presence of the puck when the puck is moved to the location of the light; a controller for controlling the lights to be selectively and repeatedly turned on and off, only one light being on at any time, the controller recording a score of one point each time the puck is moved to the location of the light while the light is on; and a substantially elevated display panel disposed in front of the horizontally positioned board for displaying the locations of the lights on the playing surface with an instant on-and-off condition of the lights to guide the hockey player in a head-up position, to move the puck on the playing surface to the location of the light on the playing surface which is currently turned on.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
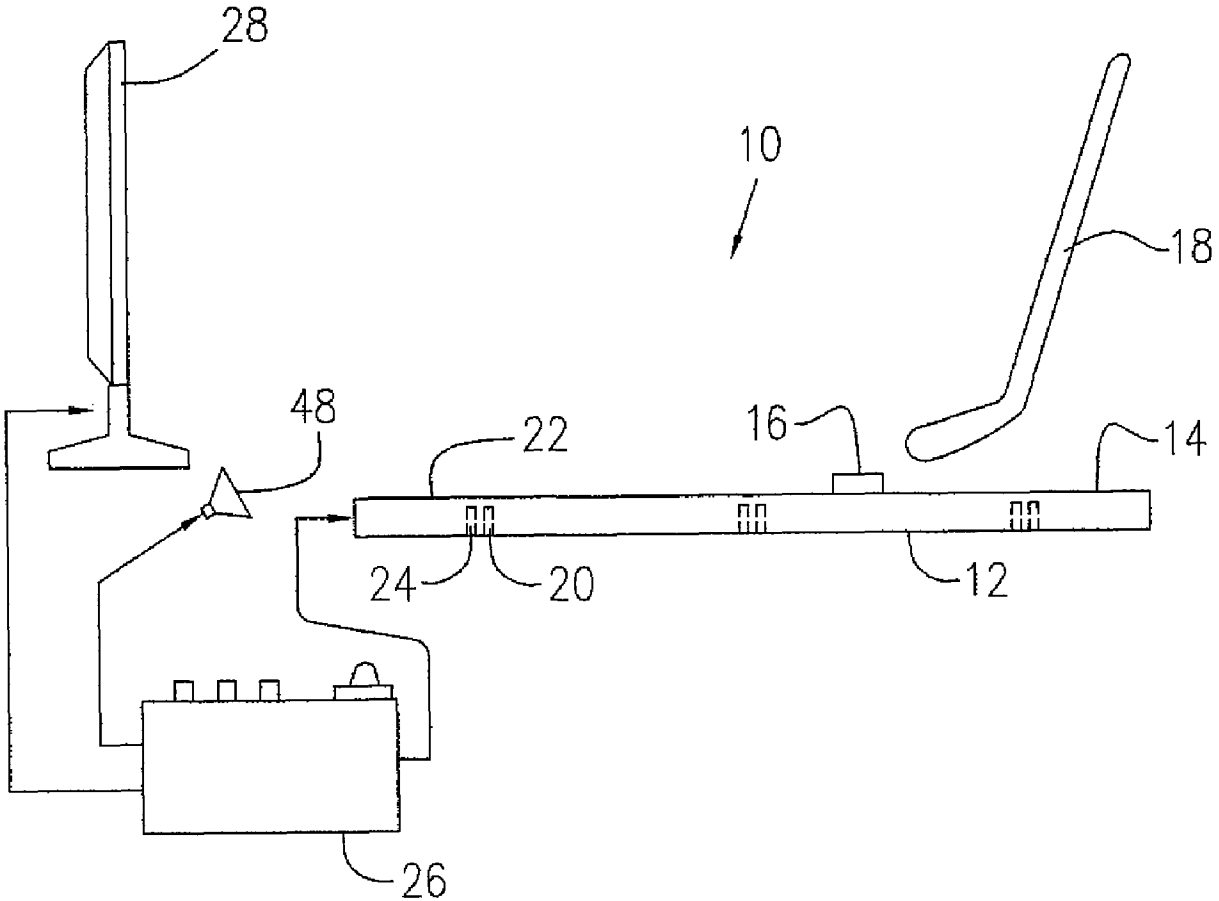
FIG. 1 is a schematic illustration of a hockey training device according to an embodiment of the present invention.
Figure 2:
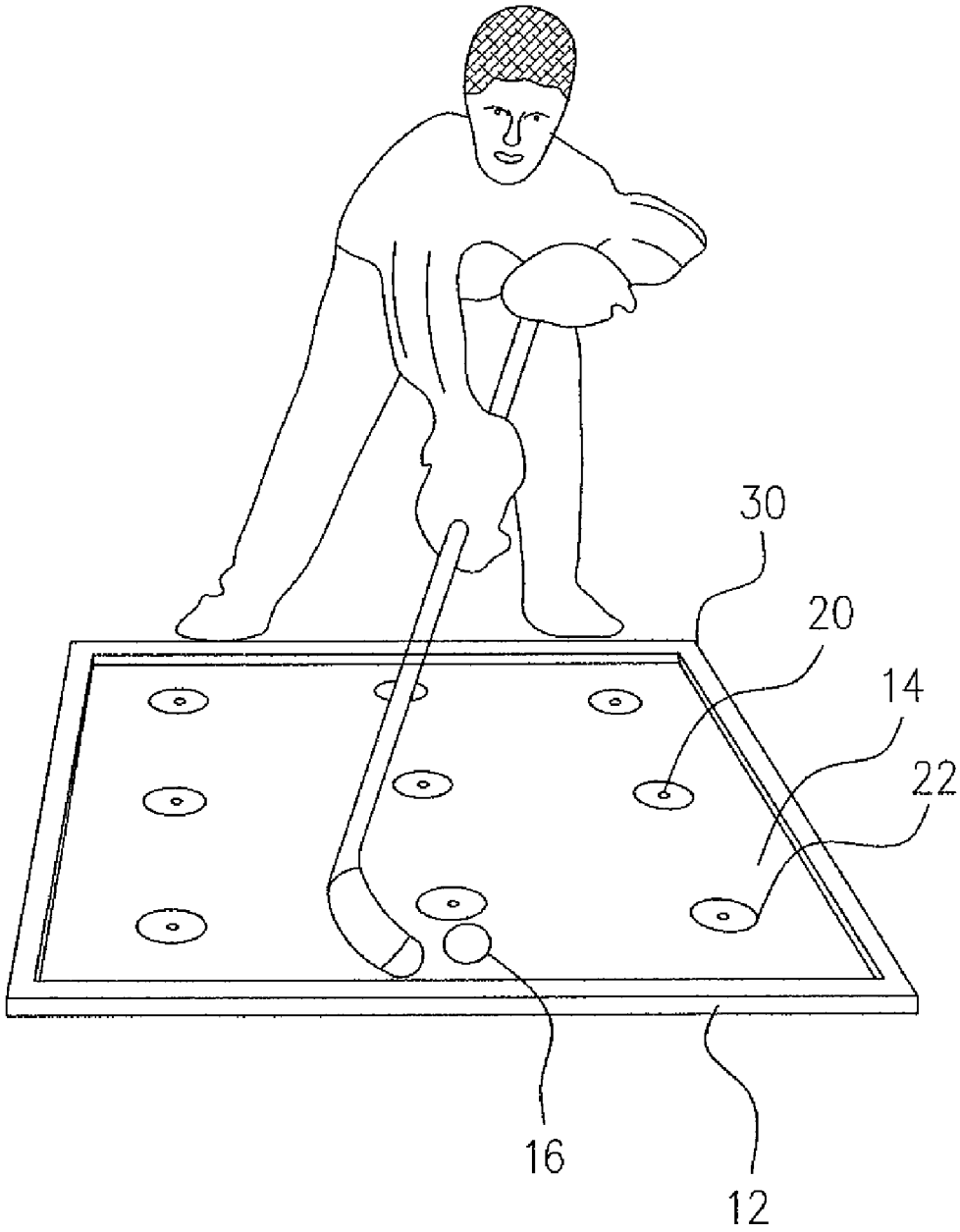
FIG. 2 is an illustration of a player in a head-up position manipulating a puck to move on a top playing surface of a board of the hockey training device of FIG. 1.
Figure 4:
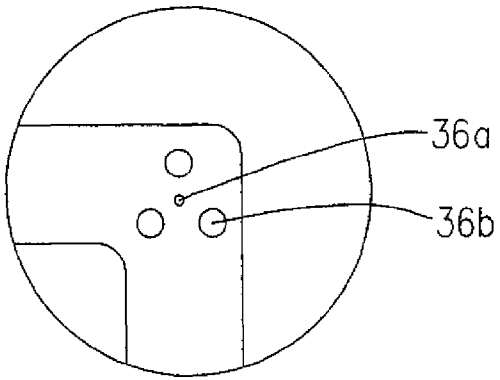
FIG. 4 is an enlarged area indicated by A in FIG. 3, showing a location on the board wherein a light and three sensors are positioned.

In FIGS. 1 and 2, a hockey training device as an embodiment of the present invention and generally indicated by numeral 10, is provided for improving a hockey player's skills of stick and puck handling, for example, particularly for improving a player's reflexes in puck control with speed and accuracy. The hockey training device 10 generally includes a board 12 substantially horizontally positioned on an indoor or outdoor ground surface. The board 12 has a top playing surface 14 on which a player manipulates a puck 16 with a hockey stick 18 in a selected game. A number of lights 20, for example LED (lighting emitting diode) lights in this embodiment, are installed under the playing surface 14 of the board 12 which may be made from wood, plastic or other suitable materials, and are distributed at desired locations, for example as indicated by numeral 22 on the playing surface 14 of the board 12. A plurality of sensors 24 is installed under the playing surface 14 of the board 12, at least one of the sensors 24 being positioned in the location 22 of each light 20, to sense the presence of the puck 16 when the puck 16 is moved to the location 22 of the adjacent light on the playing surface 14 of the board 12.

A controller 26 which may be configured as a control box as shown in FIG. 1 or as a control panel, is connected either by cables, telephone lines, or by wireless transmission to an electric circuit (not shown) in the board 12 which connects the respective lights 20 and sensors 24. The controller 26 controls the respective lights 20 to be selectively and repeatedly turned on and off such that only one light is on at any point in time and such that the one light is turned on immediately after another light is turned off during a selected game. The controller also functions as a score recorder to record a score of one point each time the puck 16 is moved on the top playing surface 14 into a location 22 of the light 20 which is in the light-on condition. These control functions may be achieved by using a microchip 26*a* (see FIG. 7) and a built-in CPU (central processing unit) 26*b* (see FIG. 7) in the controller 26.

Therefore, in a selected game of the hockey training device 10, a player handles the hockey stick 18 to move the puck 16 on the playing surface 14 of the board 12, to each of the locations 22 of the instantly illuminated lights 20 in order to score points. The player's skills of puck control in speed and accuracy can be improved through practicing stick handling with the device 10.

In a real hockey game, hockey players are required to maintain a head-up position most of the time. Therefore, a substantially elevated display panel 28, such as an LED (liquid crystal display) monitor screen as used in this embodiment, may be provided in front of the horizontally positioned board 12. The elevated display panel 28 is electrically connected either by cables or wirelessly to the controller 26 which may be equipped with a video card 26*c* (see FIG. 7) therein and is disposed on a support structure (not shown) in order to display the locations 22 of the lights 20 on the playing surface of the board 12 such that the display indicates the instant on-and-off conditions of the lights 20 of the board 12, to guide a hockey player in a head-up position, as illustrated in FIG. 2, to move the puck 16 on the playing surface 14 of the board 12 to the location 22 of the light 20 on the playing surface 14 which is currently turned on. Optionally, the display panel may also display the real time score and final score the player has achieved while playing the selected game.

In FIGS. 1-6, the board may be provided with a frame 30 along the peripheral edges of the board 12, which projects upwardly from the playing surface 14 to restrain the motion of the puck 16 within the frame 30 on the playing surface 14.

Figure 3:
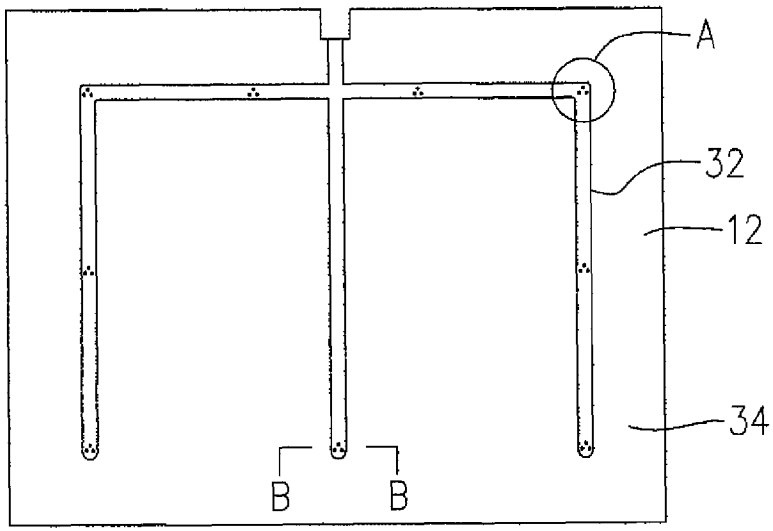
FIG. 3 is a bottom planar view of the board of the hockey training device of FIG. 1, showing a bottom side of the board, according to another embodiment, with groove connected holes for installation of electrically connected lights and sensors in the board.
Figure 5:
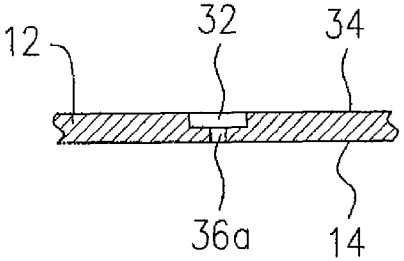
FIG. 5 is a partial cross-sectional view of the board taken along line B-B in FIG. 3, showing a cross-section of the groove.

The locations 22 of the lights 20 in this embodiment are spaced one from another on the playing surface of the board 12 in for example, three lines and three columns, as shown in FIG. 2. Another embodiment of the board 12 as shown in FIG. 3, has locations of the lights distributed only around a central area on the playing surface of the board 12. A groove network 32 may be provided in a bottom side 34 of in the board 12. The respective locations 22 of the lights 20 on the top playing surface 14 are positioned on the routes of the groove network 32 on the bottom side 34 of the board. In the groove network 32, a plurality of holes 36*a* and 36*b* are provided extending through a bottom of the grooves of the groove network 32 and exiting the top playing surface 14 in the respective locations 22. The holes 36*a* are used to position the respective lights 20 and the holes 36*b* are used to position the respective sensors 24. In each location 22, at least one hole 36*a* and one hole 36*b* are provided. The lights 20 and sensors 24 are positioned in the respective holes such that a top end of the lights 20 and sensors 24 does not project from the top playing surface 14 of the board 12 in order to not impede or redirect the puck as it moves across the board 12.

In this embodiment, three holes 36*b* are provided around one hole 36*a* in each location 22 to allow three sensors 24 to be placed around one light 22.

Figure 6:
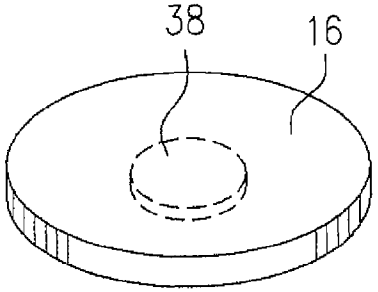
FIG. 6 is a perspective view of a puck having a magnetic core used in the hockey training device of FIG. 1.

Sensors 24 may be of any type which is capable of sensing the presence of the puck 16 in this location. For example, the sensors 24 may be magnet active contacts and the puck 16 may include a magnetic core 38 as shown in FIG. 6. The magnetic core 38 of the puck 16 will actuate one of the magnet-active contacts to send an electric signal to the controller 26 when the puck 16 is moved to the location where this magnet-active contact is positioned. The groove network 32 at the bottom side 34 of the board 12 contains wires which are part of a circuit connecting the respective light 20 and sensors 24 in the board 12.

Figure 7:
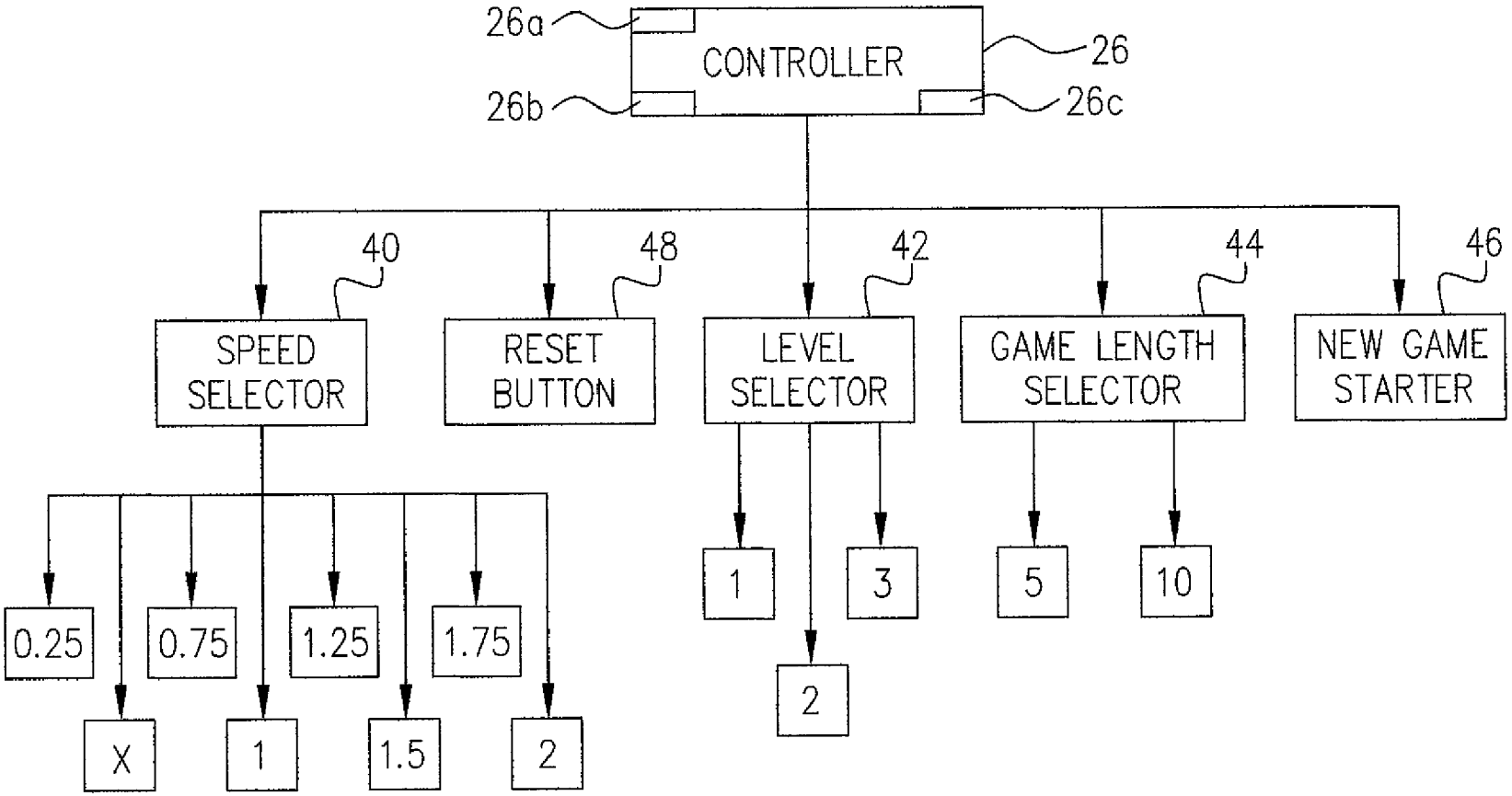
FIG. 7 is a block diagram showing selective functions of the controller of the hockey training device of FIG. 1, for setting a game with selected parameters.

Referring to FIGS. 1-2 and 7, the controller 26 provides selections of various game parameters in different combinations to allow a player to select a desired game which meets the player's particular training needs and is suitable for the player's current skill level. The controller 26 in this embodiment may include a plurality of game parameter selectors which may be configured as switches, rotatable knobs, press buttons, or the like. For example, a speed selector 40 is provided for selection of a time length each of the lights 20 is turned on. The speed selector 40 used in the controller 26 in this embodiment may include a plurality of time length selections in a time range from 0.25 and 2.0 seconds. For example, the speed selector 40 of the controller 26 may select a time length each of the lights 20 is turned on, to be 0.25, 1.75, 1.0, 1.25, 1.5, 1.75 or 2.0 seconds. Shorter lengths of time make it more difficult for the player to score because the player must move the puck faster into the location 22 of the light 20 which is on before it turns off.

An optional selection provided by the speed selector 40 (marked with letter X) may be added to allow a player to select a least difficult selection which may be referred to as "Follow Me", which allows each light 20 to change from a light-on condition to a light-off condition only when the puck 16 is moved to the location 22 of the light which is currently on. Therefore, each light 20 which is in the light-on condition will remain in the light-on condition until the puck 16 is moved to the location of that light 20 thereby activating the sensor 24 in the same location.

The controller 26 may be further provided with a game level selector 42 for selecting one of several game levels having different light-on modes to allow a range of difficulty settings of a selected game. For example, the level selector 42 in this embodiment may include a first level in which the individual lights 20 are instantly turned on in a regular sequence, for example, one after an adjacent one in a line and one line after another line. This level provides a good start for beginners by allowing the player to become familiar with the game. This level may also be used by experienced players who want to develop new techniques, strengthen new concepts and puck control or develop soft skills during rehabilitation from injury.

The level selector 42 in this embodiment may include a second, more difficult level in which the individual lights 20 are instantly turned on in an irregular sequence, particularly in strategic areas of the board 10, which makes this level challenging, exciting and fun. This irregular sequence used in level 2 is repeated in the same level of every selected game.

The level selector 42 in this embodiment may further include a third, still more difficult level in which the individual lights 20 are instantly turned on in a new irregular sequence different from a light-on mode in the same level of a previously selected game. Therefore, this level will provide a new light-on mode in an irregular basis every time a player starts a new game at the third level. This level will make the player an expert at controlling the puck with greater speed and accuracy.

In an alternative embodiment the level selector may have nine game levels to be selected. Each of the nine game levels provides a light-on sequence different from those in other game levels, thereby providing more selections of game difficulty levels between a beginner level and an expert level in order to meet various needs of players.

The controller 26 may further include a game length selector 44 for selecting a game length which is achieved by selecting the number of times each of the lights 20 will be turned on during the selected game. Therefore, the total length a selected game is equal to the number of lights 20 installed in the board 12 multiplied by the selected number of times each light 20 is turned on. For example, the game length selector 44 in this embodiment may have selections 5 and 10 such that the player may select that each of the lights 20 is to be turned on five or ten times during the selected game. Therefore, if the game length "5" is selected and there are nine lights 20 in the board 12, the lights 20 will be turned on forty-five times in total (5×9) and a maximum score which can be achieved is 45 points.

The game length selector 44 in this embodiment may further have a length 10 in which each of the lights 20 will be turned on ten times, resulting in 90 total light-on conditions in the selected game and a maximum score of 90 points.

However, the duration of time of a game may vary when either "5" or "10" game length is selected because the duration of the light-on condition of each light is selectable, for example from 0.25 to 2.0 seconds.

In another alternative embodiment, a game length selection is achieved by simply selecting a time duration of the game, for example 20 seconds or 45 seconds. Therefore, when the time length is selected, each game will last a fixed duration of either 20 seconds or 45 seconds. However, a maximum score which can be made in each game may vary due to the different speed selections.

The controller 26 may further include a new game starter 46 for starting a new game. When the new game starter is actuated, the respective speed selector 40, level selector 42 and game length selector 44 may be activated, a new selected game may begin for example after a five second delay to allow the player be ready to start the new game. Optionally, after all new game parameters are selected and the new games starter is actuated again, a countdown of 5 seconds and "Go" will be shown on the display panel 28, indicating the start of a new game. When a new game is to be started, it is suggested that the puck should be placed in a predetermined location on the top playing surface 14 of the board 12 which is referred to as a starting position, and which may be located for example in a central point on the playing surface 14 of the board 12.

All selected parameters of a new game may also be displayed on the display panel 28 for example during the five seconds delay between the completion of parameter selection and the start of the new game.

Optionally, a small outer speaker 48 connected to the controller 26 may be provided to announce those selected game parameters before the new game starts using recorded voice messages. The speaker 48 may also be activated to instantly announce each point made in a selected game.

The controller 26 may further include a reset button 48 to re-set the memory of the parameters and scores recorded in the controller 26 prior to the start of a new game.

The board 12 may be provided in an appropriate size which is large enough for practice but not too large for portability. For example, the boards may vary in size such a 2 feet by 4 feet, 4 feet by 4 feet or 6 feet by 8 feet.

In a further alternative embodiment, the lights installed in the board may be omitted without other substantial changes. With the understanding of similarities to the above described embodiment, the alternative embodiment may have only a number of sensors installed under the playing surface of the board and distributed at desired locations on the playing surface, at least one of the sensors being positioned at each of the locations to sense the presence of the puck when the puck is moved to the location. The display panel displays the locations of the sensors on the playing surface. The display panel is controlled by the controller to instantly and repeatedly mark, for example by coloring or illuminating, the individual locations displayed on the display panel, only one location being marked at any time, in order to guide the hockey player in a head-up position, to move the puck to the corresponding location of the sensor on the playing surface which is currently marked on the display panel. The controller records a score of one point each time the puck is moved to the corresponding location on the playing surface which is currently marked on the display panel. Instead of selecting the parameters of the on-and off conditions of the lights in the board as described in the previous embodiment, the respective selectors according to this embodiment control the selections of parameters for changes of the marking of the individual locations on the display panel.

The embodiments of the invention described above is intended to be exemplary only, and one skilled in the art will recognize that changes may be made to the embodiments described without departure from the scope of the invention disclosed. For example, the locations of the lights on the playing surface of the board may be distributed differently from those shown in the drawings of this application. The selectable game parameters may vary from those of the disclosed embodiments. Still other modifications which fall within the scope of the present invention will be apparent to those skilled in the arts. The scope of the invention is therefore intended to be limited solely by the scope of the appended claims.

I claim:

1. A hockey training device comprising:

a hockey puck;

a substantially horizontally positioned board having a top playing surface, the board being positioned on a floor and the puck being moved on the playing surface by a player using a hockey stick during selected games;

a number of lights installed under the playing surface of the board and distributed at desired locations on the playing surface, wherein said lights are (A) distributed so as to form a regular grid, wherein each unit of the grid contains only one light, or (B) positioned only around a central area of the playing surface of the board;

a plurality of sensors installed under the playing surface of the board, at least one sensor being positioned at the location of each light to sense the presence of the puck when the puck is moved to the location of the light;

a controller for controlling the lights to be selectively and repeatedly turned on and off, only one light being turned on at any time, the controller recording a score of one point each time the puck is moved to the location of the light while the light is on; and a substantially elevated display panel disposed in front of the horizontally positioned board for displaying the locations of the lights on the playing surface with an instant on-and-off condition of the lights to guide the hockey player in a head-up position, to move the puck on the playing surface to the location of the light on the playing surface which is currently turned on.

2. The hockey training device as defined in claim 1 wherein the controller comprises a speed selector for selecting a length of time in seconds each of the lights is to be turned on each time.

3. The hockey training device as defined in claim 2 wherein the speed selector comprises a plurality of time length selections in a time range of 0.25 to 2.0 seconds.

4. The hockey training device as defined in claim 3 wherein the speed selector further comprises a time length selection in which each light changes from a light-on condition to a light-off condition only immediately after the puck is moved to a location of the light which is on.

5. The hockey training device as defined in claim 1 wherein the display panel displays a real time score and a final score in the selected game.

6. The hockey training device as defined in claim 1 further comprising a speaker to instantly announce each point made in the selected game.

7. The hockey training device as defined in claim 1 wherein the controller comprises a game length selector for selecting a duration of time of the selected game.

8. The hockey training device as defined in claim 1 wherein the controller comprises a game length selector for selecting a number of times each of the lights is to be turned on during the selected game.

9. The hockey training device as defined in claim 1 wherein the controller comprises a game level selector for selecting one of several game levels having different light-on sequences to set a difficulty level of a selected game.

10. The hockey training device as defined in claim 9 wherein the controller comprises a microchip and a built-in CPU.

11. The hockey training device as defined in claim 1 wherein the controller comprises a starter for starting a new game.

12. The hockey training device as defined in claim 1 wherein the display panel comprises a LCD screen.

13. The hockey training device as defined in claim 1 wherein the lights are LED lights.

14. The hockey training device as defined in claim 1 wherein the lights are distributed so as to form a regular grid, wherein each unit of the grid contains only one light.

15. The hockey training device as defined in claim 1 wherein the lights are positioned only around a central area on the playing surface of the board.

16. The hockey training device as defined in claim 1 wherein each desired location of the board defines at least two holes extending through the board for positioning one of the lights and the at least one sensor, respectively.

17. The hockey training device as defined in claim 1 wherein the sensors are magnet-active contacts and wherein the puck comprises a magnetic core.

18. A hockey training device comprising:

a hockey puck;

a substantially horizontally positioned board having a top playing surface, the board being positioned on a floor and the puck being moved on the playing surface by a player using a hockey stick during selected games;

a number of sensors installed under the playing surface of the board and distributed at desired locations on the playing surface, at least one of the sensors being positioned at each of the locations to sense the presence of the puck when the puck is moved to the location, said locations being (A) distributed so as to form a regular grid, wherein each unit of the grid contains only one said location, or (B) positioned only around a central area of the board;

a controller for setting parameters of a selected game and recording a score of points in the selected game;

a substantially elevated display panel disposed in front of the horizontally positioned board for displaying the locations of the sensors on the playing surface, the display panel being controlled by the controller to instantly and repeatedly mark the individual locations displayed on the display panel, only one location being marked at any time, in order to guide the hockey player in a head-up position, to move the puck to the location of the sensor on the playing surface which is currently marked on the display panel; and wherein the controller records a score of one point each time the puck is moved to the location on the playing surface which is currently marked on the display panel.

19. The hockey training device as defined in claim 1 wherein two or more sensors are positioned at the location of each light.

20. The hockey training device as defined in claim 1 wherein three sensors are positioned at the location of each light.

* * * * *